US006735924B2

(12) United States Patent
Graffin

(10) Patent No.: US 6,735,924 B2
(45) Date of Patent: May 18, 2004

(54) DEVICE FOR PRESENTING LIDS TO MOVING SEALING STATIONS

(75) Inventor: Jean-Jacques Graffin, Kuala Lumpur (MY)

(73) Assignee: Serac Group, La Ferte Bernard (FR)

( * ) Notice: Subject to any disclaimer, the term of this patent is extended or adjusted under 35 U.S.C. 154(b) by 0 days.

(21) Appl. No.: 10/046,779

(22) Filed: Jan. 17, 2002

(65) Prior Publication Data

US 2002/0092266 A1 Jul. 18, 2002

(30) Foreign Application Priority Data

Jan. 17, 2001 (FR) ..... 01 00582

(51) Int. Cl.[7] ..... B65B 7/28
(52) U.S. Cl. ..... 53/290; 53/298; 493/81
(58) Field of Search ..... 53/298, 290; 493/71, 493/81; 83/650

(56) References Cited

U.S. PATENT DOCUMENTS 3,789,714 A * 2/1974 Demny ..... 83/272
3,983,774 A * 10/1976 Seragnoli ..... 83/289
4,139,979 A * 2/1979 Nakazato et al. ..... 53/298
4,267,752 A * 5/1981 Byrt et al. ..... 83/74
4,516,380 A * 5/1985 Buckner et al. ..... 53/282
4,575,987 A * 3/1986 Fortuna ..... 53/298
4,694,714 A * 9/1987 Focke et al. ..... 83/13
4,773,293 A * 9/1988 Mizuta et al. ..... 83/39
4,982,554 A * 1/1991 Corniani ..... 53/290
5,363,629 A 11/1994 Graffin
5,371,996 A * 12/1994 Ueda et al. ..... 53/298
5,408,805 A * 4/1995 Graffin ..... 53/487
5,448,934 A * 9/1995 Boldrini et al. ..... 83/42
5,505,398 A * 4/1996 Emmerich ..... 242/360
6,016,641 A * 1/2000 Nagano ..... 53/298
6,085,489 A * 7/2000 Bachner et al. ..... 53/410

FOREIGN PATENT DOCUMENTS

FR 2247387 5/1975

* cited by examiner

*Primary Examiner*—Rinaldi I. Rada
*Assistant Examiner*—Gloria R Weeks
(74) *Attorney, Agent, or Firm*—Young & Thompson

(57) ABSTRACT

A device for presenting lids to moving sealing stations. The device includes at least one lid production module mounted stationary relative to a path of the sealing stations and having a lid cutting member fitted with a cutting tool for cutting lids from a strip. Gripping members are secured to the sealing stations. The gripping members are disposed relative to the lid production module so as to take hold of a lid on the fly.

11 Claims, 4 Drawing Sheets

DEVICE FOR PRESENTING LIDS TO MOVING SEALING STATIONS

The invention relates to a device for presenting lids to moving sealing stations in a heat-sealing machine.

BACKGROUND OF THE INVENTION

In general, a heat-sealing carousel comprises a turntable with a plurality of stations disposed around its periphery for heat-sealing receptacles, each station heat-sealing a lid onto a receptacle between the receptacle being introduced to the turntable and being ejected from the turntable. A difficulty with heat-sealing devices lies in producing and positioning lids so as to be immediately adjacent to the openings of receptacles without interfering with the receptacles or the heat-sealing heads.

Document FR-A-2 688 192 discloses a heat-sealing carousel comprising a series of moving heat-sealing stations, each station being fitted with a lid presenting device comprising a lid production module having a member fitted with a tool for cutting lids from a strip, and a gripping clamp placed facing the lid production module to pull the strip before actuating the cutting tool.

Since there are as many presentation devices as there are sealing stations on the carousel, the structure of such carousels is bulky, complex, and expensive to manufacture. In addition, replacing reels of heat-sealing strip requires the carousel to be stopped, to the detriment of production throughput.

OBJECTS AND SUMMARY OF THE INVENTION

The invention provides a device for presenting lids to moving sealing stations, the device comprising at least one lid production module mounted stationary facing a path of the sealing stations and having a lid cutting member fitted with a tool for cutting lids from a strip, and also having gripping members secured to the sealing stations, the gripping members being placed relative to the lid production module so as to take hold of a lid on the fly.

Thus, a single lid production module can be used for all of the sealing stations, such that the general structure of the sealing machine is considerably simplified, while nevertheless ensuring that lids are held accurately in position by means of gripping members associated with each station.

In an advantageous version of the invention, the lid production module includes a member for advancing lids disposed downstream from the cutting tool.

It is thus possible to increase the distance between the cutting tool and the moving stations sufficiently to have all the space required for giving good accessibility to the lid production module without any risk of interference with the sealing heads.

Advantageously, the lid cutting member includes a support for two reels of strip, and a selector suitable for causing one of the strips to advance towards the cutting tool for cutting up the strip downstream from the selector.

It is thus possible to change one of the reels without stopping the production of lids.

Also advantageously, the selector comprises three rollers having parallel axes and mounted to enable one of them to move relative to the other two between two extreme positions, in each of which positions two rollers co-operate to pinch one of the strips, at least one of the two rollers between which a strip is pinched being a drive roller.

The advancing strip is thus selected merely by switching the movable roller from one extreme position to the other.

Preferably, the selector has two brakes arranged to act positively on the strip which is not being pinched in order to stop it from moving.

This provides positive braking of the non-advanced strip (s), thereby eliminating the risk of two strips interfering with each other.

Furthermore, in existing devices, the cutting tool is generally of the guillotine or scissor type, which means that the strip must be stopped in order to be cut.

In an aspect of the invention, the cutting tool comprises both a rotary blade-carrier fitted with at least one blade having a cutting edge and a rotary backing cylinder, the blade-carrier and the backing cylinder being mounted facing each other on parallel axes, the cutting edge being mounted so as to make tangential contact with the backing cylinder.

By causing the strip to pass between the blade-carrier and the backing cylinder, the strip is cut by means of continuous rotary motion. It is easy to synchronize the driving and the cutting of the strip with the travel of the sealing stations.

Preferably, the blade is curved symmetrically about a midplane of the blade-carrier, which plane extends perpendicularly to the axis of rotation of the blade-carrier.

In this way, by causing the middle axis of the strip to coincide with said plane, lids are obtained that naturally present two symmetrical tongues, thus making it easy to open a receptacle.

In a preferred embodiment, the blade is curved with a radius of curvature approximately equal to half the width of the strip, and the dimensions of the blade-carrier are adapted to make cuts that are spaced apart from one another by a distance that is substantially equal to the width of the strip.

It is thus possible to optimize strip consumption by making lids of dimensions that are just sufficient to cover the openings of the receptacles.

BRIEF DESCRIPTION OF THE DRAWINGS

Other characteristics and advantages of the invention appear in the light of the following description of a preferred and non-limiting embodiment of the invention, described with reference to the accompanying figures, in which.

MORE DETAILED DESCRIPTION

Figure 1:
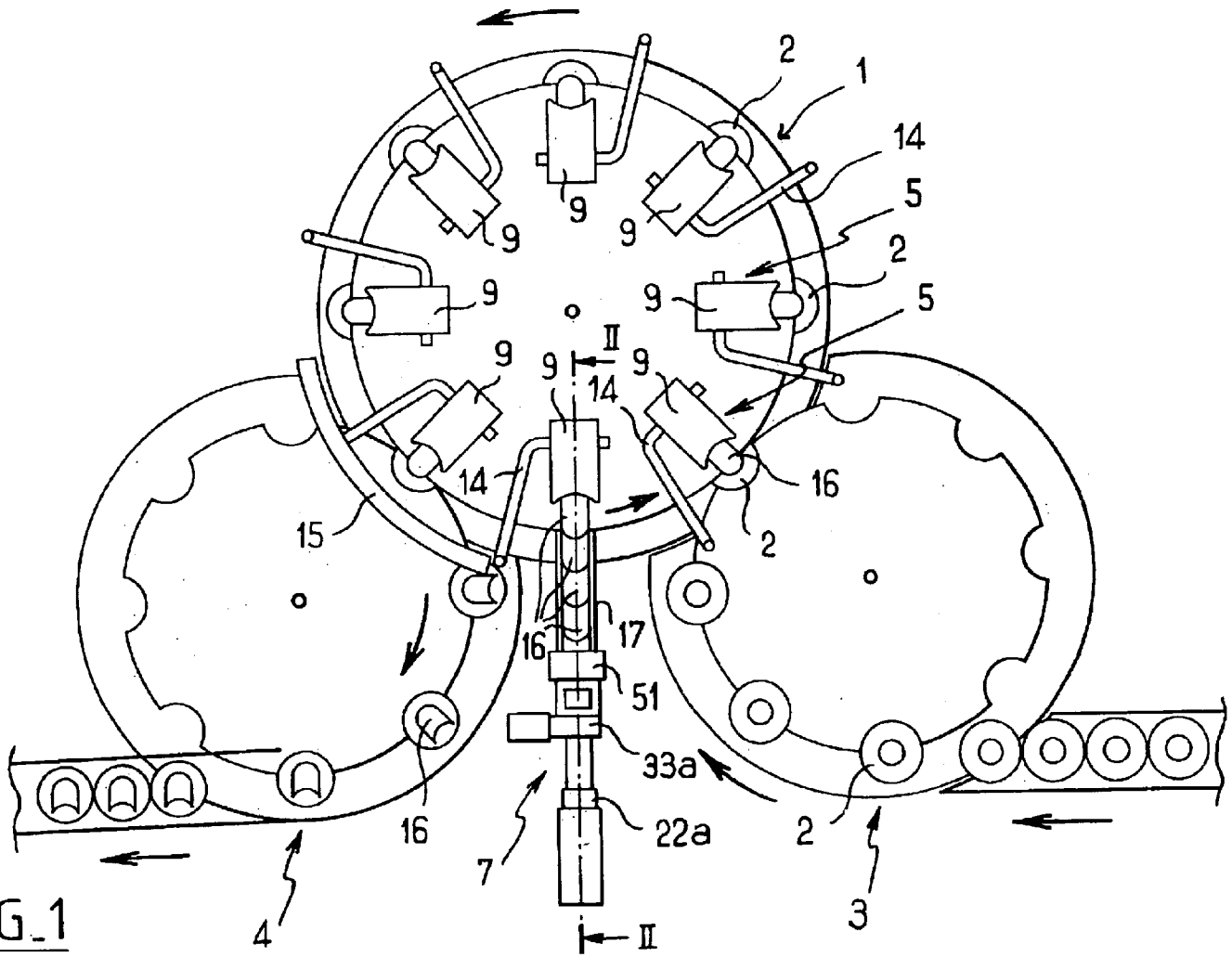
FIG. 1 is a diagrammatic plan view of a heat-sealing carousel fitted with a lid presentation device of the invention.

With reference to FIG. 1, a heat-sealing carousel comprises in conventional manner a turntable 1 for supporting receptacles 2 inserted onto the turntable 1 by an upstream transfer device 3 and removed therefrom by a downstream transfer device 4.

The receptacles 2 are conveyed by the upstream transfer device 3 to one of the moving sealing stations 5 of the carousel. Each sealing station comprises a heat-sealing head 6 (see FIG. 2) disposed vertically above a location for a receptacle. For better understanding, the heat-sealing heads 6 are not shown in FIG. 1.

In the invention, the lid presentation device comprises a lid production module given overall reference 7 placed in stationary manner on the side of the turntable 1 between the downstream transfer device 4 and the upstream transfer device 3, where "upstream" and "downstream" are determined relative to the direction of rotation of the turntable 1.

Figure 2:
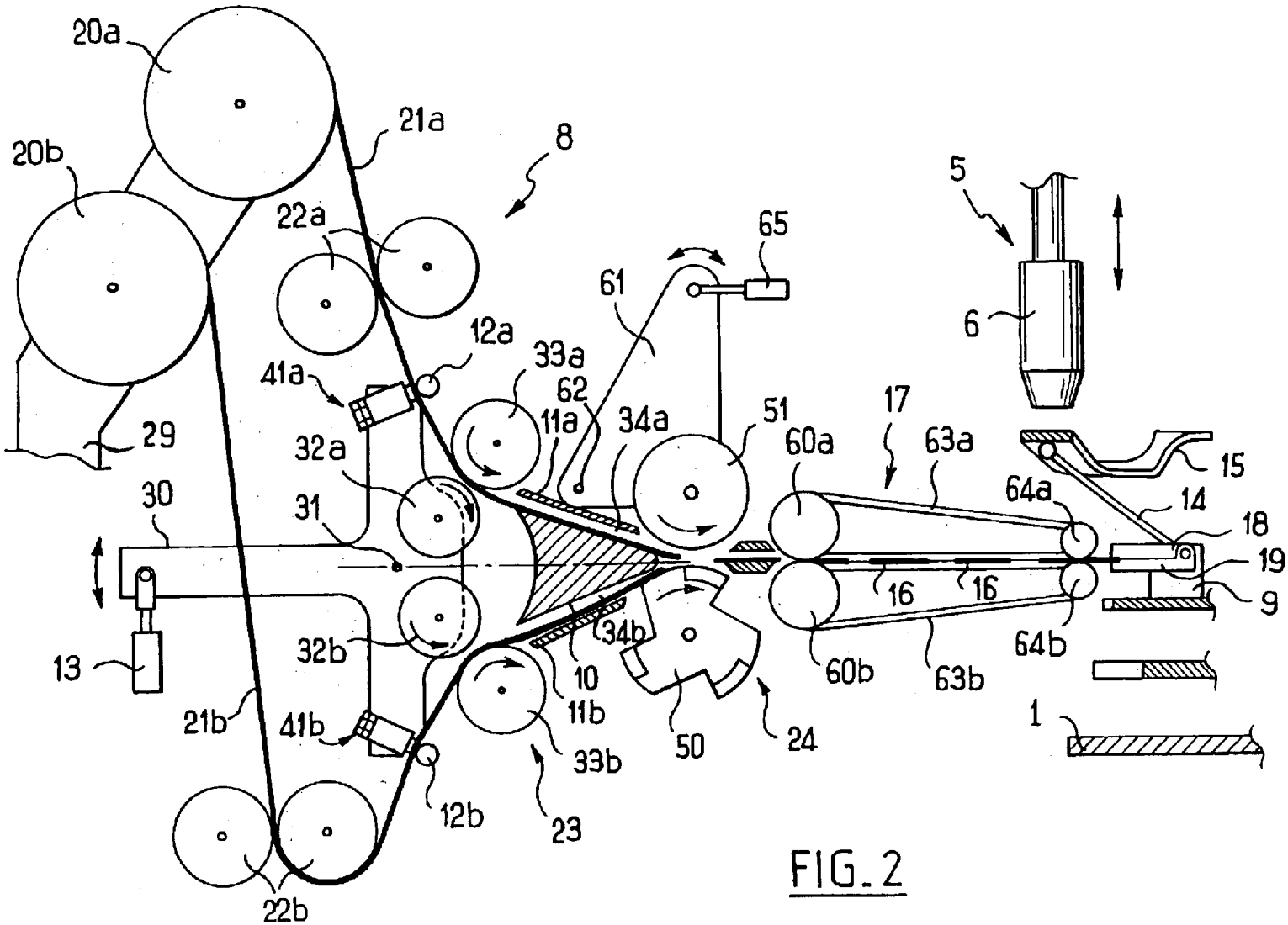
FIG. 2 is a diagrammatic section on line II—II of FIG. 1.
Figure 3:
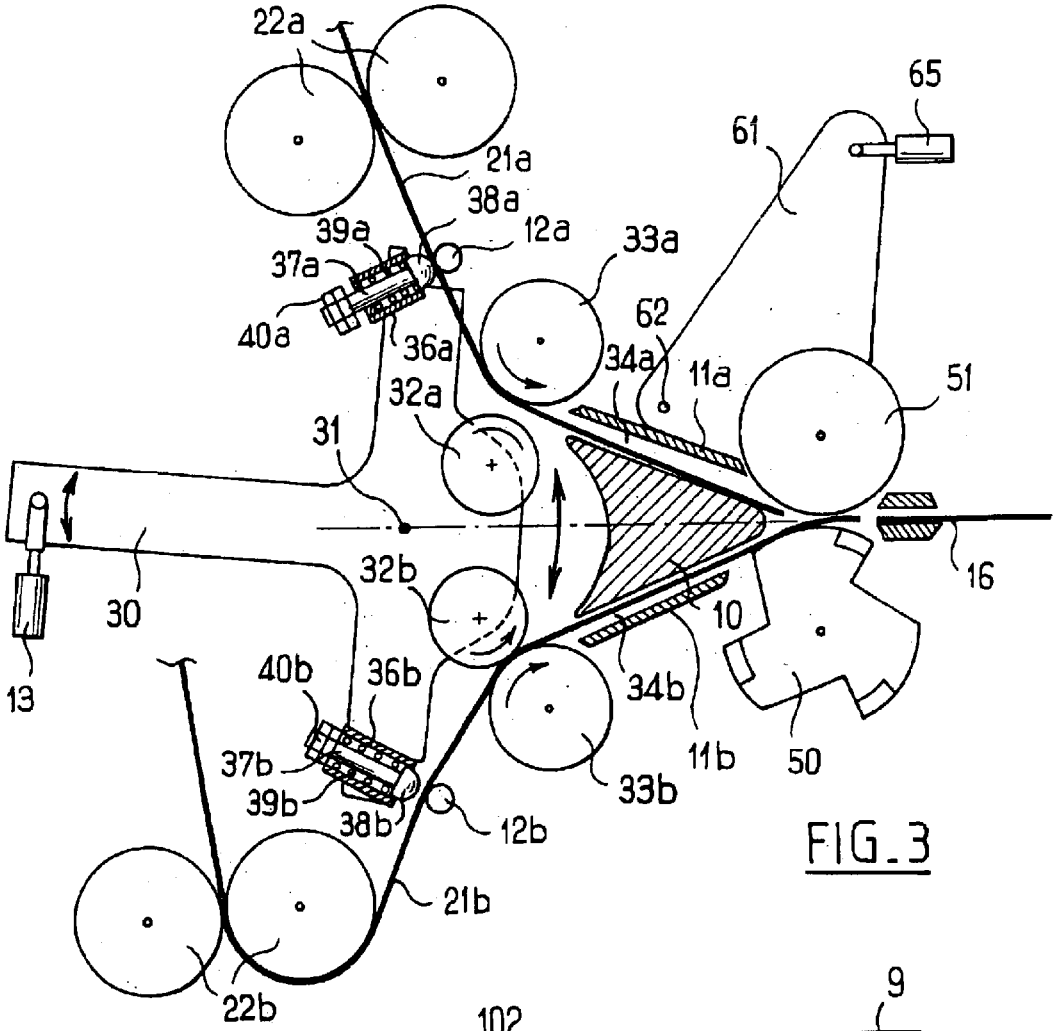
FIG. 3 is an enlarged fragmentary view of FIG. 2 showing the strip selector.

With reference to FIGS. 2 and 3, the lid production module comprises a lid cutting member given overall reference 8 and associated with an advance member 17. The lid cutting member 8 comprises a support 29 arranged to receive two reels 20*a* and 20*b* carrying respective heat-sealable strips 21*a* and 21*b*. The strips 21*a* and 21*b* pass between two respective pairs of guide rollers 22*a* and 22*b* and they are engaged in a selector 23 shown in a neutral position in FIG. 2.

With reference to FIG. 3, the symmetrical elements described are distinguished by indexes constituted by lower case letters a and b. The selector 23 has a lever 30 mounted to pivot about an axis 31 that is substantially horizontal and perpendicular to the advance direction of the strips 21. At one end, the lever 30 carries two rollers 32*a* and 32*b* parallel to the pivot axis 31 of the lever 30. Under the control of a control member 13 such as an electromagnet, the lever 30 can be moved between two extreme positions in which one of the rollers 32 co-operate with one of two fixed rollers 33*a* and 33*b* in order to pinch the corresponding strip 21. The fixed rollers 33 are rotated by a drive member (not shown) and they are fitted with gearwheels co-operating respectively with gearwheels carried by the rollers 32 so as to drive them synchronously with the rollers 33 even when a roller 32 is spaced apart from the corresponding roller 33. The rollers 32 and 33 are thus driven constantly and enable the corresponding strip to be driven immediately from the instant at which it is pinched. In FIG. 3, the idle roller 32*b* is shown as co-operating with the fixed roller 33*b*. The strip 21*b* is pinched between the roller 32*b* and the drive roller 33*b*, and rotation thereof forces the strip 21*b* to advance along a fixed guide channel 34*b* defined by a fixed central bearing block 10 and a fixed side wall 11*b*.

Simultaneously, the strip 21*a* is prevented from moving in the channel 34*a* by a brake 41*a* comprising a cylinder 36*a* secured to the lever 30 in which a sliding finger 37*a* is mounted. The sliding finger 37*a* is urged by a spring 39*a* so that its end 38*a* adjacent to the strip 21*a* bears against it and pinches it against a fixed abutment 12*a*. In addition, the strip 21*a* is not driven since the drive roller is spaced apart from the roller 33*a* and therefore does not pinch the strip 21*a*.

In parallel, the brake 41*b* is spaced apart from the corresponding strip 21*b*. In this position a nut 40*b* fixed on the end of the finger 37*b* opposite from its bearing end 38*b* bears against the corresponding end of the cylinder 36*b* and thus limits the stroke of the finger 37*b*. The strip 21*b* is therefore free to slide in the channel 34*b*.

The selector 23 operates symmetrically. To drive the strip 21*a*, it suffices to move the control member 13 so as to cause the lever 30 to tilt in such a manner that the roller 32*a* co-operates with the roller 33*a*, the strip 21*b* then being stopped by the brake 41*b*. As shown in FIG. 2, there also exists an intermediate neutral position in which both strips 21*a* and 21*b* are stopped.

To change a reel, it suffices to move the selector 23 so as to stop the strip from the corresponding reel. It is then possible to remove the reel and change it, without interrupting the delivery of lids since the strip from the other reel is then being driven.

The bearing force from the springs 39*a* and 39*b* urging the fingers 37*a* and 37*b* against their abutments 12*a* and 12*b* naturally returns the lever 30 towards its neutral position. In the event of an electrical failure or a breakdown of the control member 13, strip advance is thus automatically stopped.

Strip advance is synchronized with the rotation of the turntable 1 by acting on the speed of rotation of the drive rollers 33*a* and 33*b*, which speed is selected to be proportional to the speed of the turntable 1.

The selected strip then reaches a cutting tool given overall reference 24.

Figure 4:
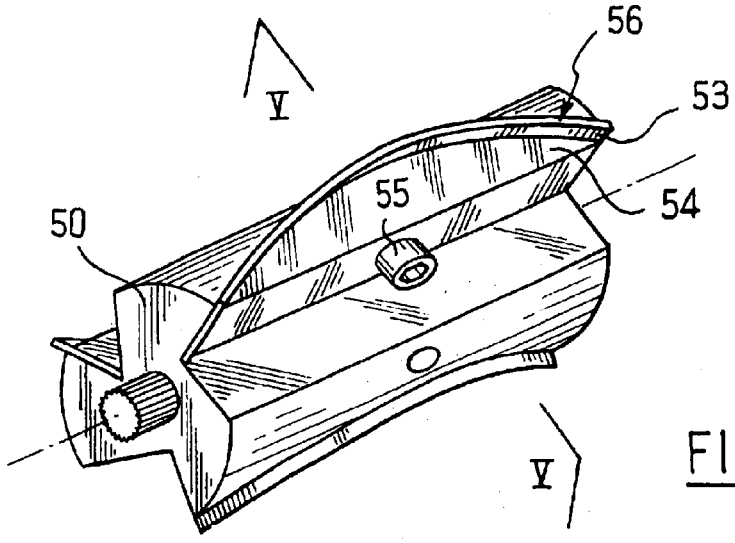
FIG. 4 is a perspective view of the cutting tool of the invention.
Figure 5:
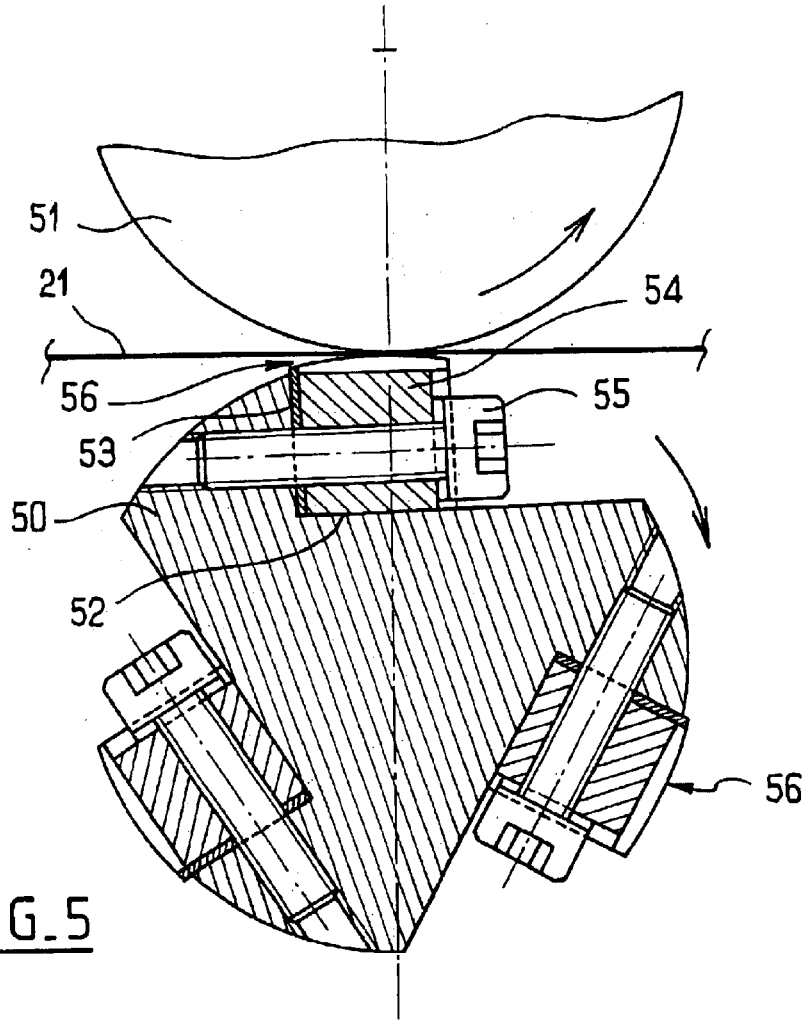
FIG. 5 is a section on plane V—V of FIG. 4.

With reference to FIGS. 4 and 5, the cutting tool 24 comprises a blade-carrier 50 of substantially cylindrical shape, comprising three slots 52 formed at 120° intervals from one another. Blades 53 are held in the bottoms of the slots 52 by spacers 54 matching the shape of the slots and held in place by screws 55 passing through the spacers 54 and the corresponding blades 53. The cutting edge 56 of each blade 53 projects from the blade-carrier 50 so as to come tangentially into contact with a facing backing cylinder 51 mounted to rotate about an axis parallel to the axis of the blade-carrier 50. The blades 53 are symmetrical in shape about a midplane perpendicular to the axis of rotation of the blade-carrier 50.

The strip 21 is presented perpendicularly to the axes of rotation between the blade-carrier 50 and the backing cylinder 51, and it is cut progressively by the edge 56 bearing against the backing cylinder 51 along a curved line of cut representing the trace of points where the edge 56 is tangential to the backing cylinder 51. In order to obtain continuous tangential contact between the edge 56 and the backing cylinder 51, the blades 53 are preferably sharpened by installing the blade-carrier 50 fitted with unsharpened blades in register with a grindstone having the same diameter as the backing cylinder 51, and then putting said grindstone into fast rotation while the blade-carrier 50 is simultaneously caused to rotate slowly. It is thus possible to keep a spare blade-carrier 50 fitted with sharp blades. The blades can thus be changed very quickly by removing the blade-carrier which is preferably held merely by a screw on a shaft that determines its angular position so that replacement can be performed in a very short length of time.

The cutting tool 24 moves in rotation only, so it is easy to synchronize it with the rotation of the carousel. This means is particularly suitable for cutting lids apart quickly.

In order to ensure that, when the selector 23 is in the neutral position, a strip cannot be driven in unwanted manner by the rotating cutting device 24, provision is made to mount the backing cylinder 51 on a lever 61 hinged about an axis 62 which is parallel to the axis of rotation of the backing cylinder 51, as can be seen in FIG. 2. In the position shown, the lever 61 has been moved so that the backing cylinder 51 is spaced apart from the blade-carrier 50. Neither strip can then be driven by the cutting device 24 and no lids can be delivered. This lever is controlled by means of a member 65 of the electromagnet or actuator type, and the movement of this lever can be coupled to that of the member 13.

When the lever 61 is returned to a position in which the backing cylinder 51 is tangential to the blade-carrier 50, as shown in FIG. 3, the advancing strip 21 is then cut to form lids 16.

In order to facilitate maintenance of the apparatus, the various rollers of the selector 23 and of the cutting device 24 can be mounted so as to be cantilevered out from a support plate, in which case all of the rollers are accessible and can be removed from the same side of the support plate. To further facilitate access to the various elements and to ensure that the path for the strips is completely disengaged, provision is made for the lever 30, the lever 61, and their control members to extend over the other side of the plate supporting the fixed rollers.

Figure 6:
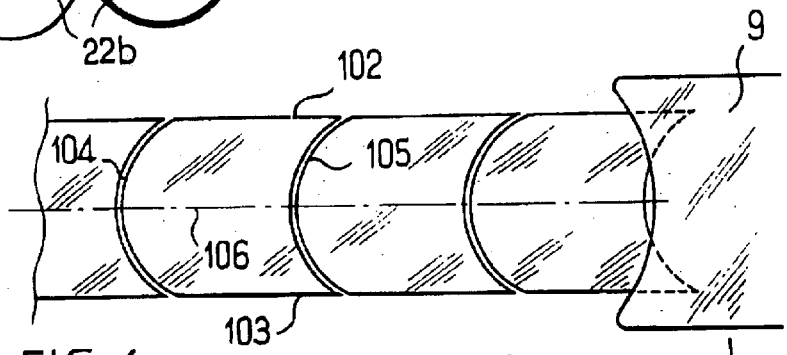
FIG. 6 is a plan view on a larger scale showing a strip cut in accordance with the invention, a lid being held by a clamp.

As shown in FIG. 6, each lid 16 has two parallel rectilinear edges 102 and 103 formed by the edges of a segment of strip, and also two curved edges 104 and 105 which are parallel to each other and symmetrical about the axis of symmetry 106 of the segment of strip. These curved edges define lids of complementary shape, which interfit without losing any strip material between two consecutive lids.

Figure 7:
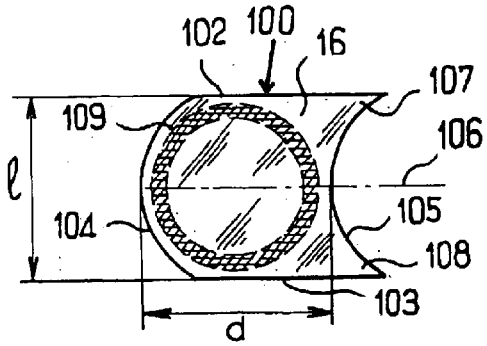
FIG. 7 is a plan view of a lid of the invention, sealed onto a receptacle.

FIG. 7 is a plan view of a lid 16 of the invention placed over the neck 109 of a receptacle. The width l of the strip 100 is selected to be slightly greater than the diameter of the neck 109. In addition, the curved shape of the line of cut serves to leave two pull tongues 107 and 108 on the lid. The radius of curvature R of the line of cut is preferably slightly greater than half the width of the strip, e.g. 24 millimeters (mm) for a strip that is 46 mm wide for fitting to a neck having a diameter of 43 mm, thereby leaving tongues that are easy to take hold of on the lid while nevertheless ensuring that the tips of the tongues are not too narrow. similarly, the cutting tool 24 is preferably dimensioned so that the distance d between the curved edges 104 and 105, i.e. the circumferential distance between two edges 56 (or the perimeter of the circle scanned by the edge 56 when only one blade is used) is substantially equal to the width l of the strip. These dispositions make it possible to minimize strip consumption while also ensuring that the neck 109 is covered in satisfactory manner.

The lids 16 as cut apart in this way are taken in charge by a lid-advance member 17, in this case a conveyor device comprising two belts 63*a* and 63*b* mounted facing each other on rollers, given respective references 60*a* & 64*a* and 60*b* & 64*b*. To limit risk of lids being contaminated, the belts 63*a* and 63*b* preferably comprise three narrow parallel strands. The lids 16 leaving the cutting device 24 are held captive in the advance member 17 between the two belts 63*a* and 63*b*, thus preventing them from becoming shifted or from turning while they are being conveyed, and they are brought onto the path of the moving stations.

Furthermore, as shown in FIG. 2, each sealing station 5 has a gripping clamp 9 comprising a fixed jaw 18 and a moving jaw 19 urged resiliently against the fixed jaw by a spring (not shown). The moving jaw 19 is associated with a control lever 14 which is used for opening the clamp under drive from a fixed cam 15 located upstream from the lid production module 7.

When a sealing station comes up to the end of the advance member 17, the clamp 9 is still held open by the cam 15. At the moment when the clamp 9 is on the axis of a lid 16 cantilevered out from the end of the advance member 17, the lever 14 escapes from the downstream end of the cam 15 and the corresponding clamp 9 closes onto the pull tongues 107 and 108 so that the lid 16 is taken hold of on the fly and is held horizontally by the clamp 9 cantilevered out over a location where a receptacle 2 is inserted by the upstream transfer device 3. During the transit between the upstream transfer device 3 and the downstream transfer device 4 in the direction of rotation of the turntable 1, the sealing head is lowered in conventional manner onto the lid 16 to heat-seal it onto the neck 109 of the corresponding receptacle 2. Immediately upstream from the downstream transfer device 4, the lever 14 is controlled by the cam 15 so as to open the clamp 9 and release the lid 16 before the receptacle 2 is removed. The sealing station 5 is thus ready to begin a new cycle.

The invention is not limited to the particular embodiments described above, but can be varied within the ambit of the invention as defined by the claims.

In particular, all rotary movements can be synchronized by means of gears or belts, or by motors that are synchronized electrically. In particular, the advance of the strip and/or slicing of the strip into lids can be associated with information indicating that a receptacle is present in the upstream transfer device. It is thus possible to suspend lid production every time that it is anticipated that a moving station passing beneath the end of the lid advance member will be empty.

Furthermore, provision can be made to place a plurality of lid production modules side by side and associated with gripping clamps 9 whose control levers 14 are offset so that only one lid 16 is taken.

The gripping clamps 9 can be driven electrically, hydraulically, or pneumatically, and they can be caused to open and close on the fly on a lid present at the end of the advance member by means other than the above-described cam-and-lever system, e.g. by means of the type controlled by a photocell secured to the clamp and receiving a beam of light that is interrupted whenever a lid is present.

The selector 23 can also have two idle rollers and a single drive roller movably mounted on the lever. It is then necessary to reverse the direction of rotation of the motor each time the lever changes over.

The invention can be transposed to any type of sealing apparatus, in particular to apparatus of the linear type.

The shape of the cut obtained by the cutting member 24 can be modified so as to make pull tongues that are disposed in diametrically opposite positions, e.g. by providing blades 53 that are curved so as to present a point of inflection.

The number of blades on the blade-carrier 50 can be arbitrary and can be adapted to the size of the lids and of the blade-carrier 50. For example, the blade-carrier 50 could have four blades, with the radius of the cylindrical surface containing the edges of the blades being adapted so that one-fourth of the circumference of said surface corresponds to the dimension of a lid.

What is claimed is:

1. A device comprising:

at least one stationary lid production module having a lid cutting member fitted with a tool for cutting lids from a strip and for presenting said lids in a cantilevered out position facing a path of one of a plurality of sealing stations, each sealing station including a sealing head, said plural sealing stations being attached to a continuously moving supporting structure, said sealing stations each having gripping members secured thereto, said gripping members being placed relative to the lid production module so as to follow a path facing said lids in the cantilevered out position, and control means for opening and closing said gripping members so as to take hold of a lid on the fly when a sealing station is moving in front of said lid production module.

2. A device according to claim 1, wherein the lid production module includes a member for advancing lids disposed downstream from the cutting tool.

3. A device according to claim 1, wherein the lid cutting member includes a support for two reels of strip, and a selector suitable for causing one of the strips to advance towards the cutting tool for cutting up the strip downstream from the selector.

4. A device according to claim 3, wherein the selector comprises three rollers having parallel axes and mounted to enable one of them to move relative to the other two between two extreme positions, in each of which positions two rollers co-operate to pinch one of the strips, at least one of the two rollers between which a strip is pinched being a drive roller.

5. A device according to claim 4, wherein the selector has two brakes arranged to act positively on the strip which is not being pinched in order to stop it from moving.

6. A device according to claim 1, wherein the cutting tool comprises both a rotary blade-carrier fitted with at least one blade having a cutting edge and a rotary backing cylinder, the blade-carrier and the backing cylinder being mounted facing each other on parallel axes, the cutting edge being mounted so as to make tangential contact with the backing cylinder.

7. A device according to claim 6, wherein the blade is curved symmetrically about a midplane of the blade-carrier, which plane extends perpendicularly to the axis of rotation of the blade-carrier.

8. A device according to claim 7, wherein the blade is curved with a radius of curvature approximately equal to half the width of the strip.

9. A device according to claim 8, wherein the radius of curvature is slightly greater than half the width of the strip.

10. A device according to claim 7, wherein the blade-carrier is of dimensions adapted to make cuts that are spaced apart from one another by a distance substantially equal to the width of the strip.

11. A device for presenting lids to moving sealing stations, the device comprising at least one lid production module having a lid cutting member fitted with a tool for cutting lids from a strip, and also having gripping members secured to the sealing stations, wherein the lid production module is mounted stationary facing a path of the sealing stations, and wherein the gripping members are placed relative to the lid production module so as to take hold of a lid on the fly, wherein the cutting tool comprises both a rotary blade-carrier fitted with at least one blade having a cutting edge and a rotary backing cylinder, the blade-carrier and the backing cylinder being mounted facing each other on parallel axes, the cutting edge being mounted so as to make tangential contact with the backing cylinder, and wherein the blade is curved symmetrically about a mid-plane of the blade-carrier, which plane extends perpendicularly to the axis of rotation of the blade-carrier.

* * * * *